US006026652A

United States Patent [19]

Wada

[11] Patent Number: 6,026,652

[45] Date of Patent: Feb. 22, 2000

[54] AIR CONDITIONING SYSTEM HAVING SINGLE BUS LINE

[75] Inventor: Keiji Wada, Oizumi-machi, Japan

[73] Assignee: Sanyo Electric Co., Ltd., Osaka, Japan

[21] Appl. No.: 08/950,288

[22] Filed: Oct. 14, 1997

[30] Foreign Application Priority Data

Oct. 18, 1996 [JP] Japan ..... P8-297114
Oct. 18, 1996 [JP] Japan ..... P8-297116

[51] Int. Cl.[7] ..... F24F 11/00

[52] U.S. Cl. ..... 62/175; 236/51

[58] Field of Search ..... 62/175, 115, 510; 236/51; 165/205, 207, 208, 209; 340/825.14, 825.2, 825.21

[56] References Cited

U.S. PATENT DOCUMENTS 5,524,107 6/1996 Duggan et al. ..... 340/825.14
5,630,324 5/1997 Yoshida et al. ..... 62/175
5,642,857 7/1997 Totsuka et al. ..... 236/51

*Primary Examiner*—Harry B. Tanner
*Attorney, Agent, or Firm*—Darby & Darby

[57] ABSTRACT

In an air conditioning system in which outdoor units and indoor units of plural air conditioning units are connected to one another through a single bus line, when signals of at least two air conditioners are output onto the bus line substantially at the same output timing, the signal output timing of at least one air conditioner is changed by timing changing means so that the output timings of the signals of the air conditioners are different from one another. Further, each of the outdoor units of the air conditioners is provided with operation data recording means for recording the operation data of the outdoor unit, operation data output means for outputting the operation data of a desired outdoor unit, and operation data transmitting means for transmitting the operation data recorded in the operation data recording means to another outdoor unit through the bus line.

7 Claims, 3 Drawing Sheets

AIR CONDITIONING SYSTEM HAVING SINGLE BUS LINE

BACKGROUND OF THE INVENTION

1. Field of the Invention

The present invention relates to an air conditioning system in which plural air conditioners are connected to one another through the same bus line, and more particularly to an air conditioning system in which data (signal) communication between each of plural outdoor units and each of plural indoor units and/or between plural outdoor units can be easily performed on the same bus line with avoiding interference between signals from the respective air conditioners on the bus line, and operation data can be easily checked between the units.

2. Description of the Related Art

In a general air conditioner, each of an outdoor unit and an indoor unit is provided with a controller, and the operation of the respective outdoor unit and the indoor unit is controlled by mutually communicating data between the outdoor unit and the indoor unit. A serial communication system has been recently utilized as a communication system, and a large amount of data are communicated (received and transmitted) between the outdoor and indoor units through a relatively narrow (for example, two cores) signal cable.

When an air conditioning system comprising plural air conditioners is set up in a building, typically the outdoor units of the respective air conditioners are arranged on the roof top or the like to be adjacent to one another, and a refrigerant pipe is set up from each outdoor unit to a corresponding indoor unit. In such a case, a signal cable of each air conditioner is also individually laid as in the case of the refrigerant pipe. However, in order to facilitate a cable laying work, etc., it has been attempted to commonly use one bus line for the respective air conditioners. That is, the respective outdoor units and the respective indoor units may be connected to one another through one bus line and each air conditioner so that each air conditioner controls the operation of the outdoor and indoor units thereof through the bus line, whereby the cable laying work can be performed by merely stringing only one signal cable from the roof top or the like, into respective rooms.

According to such an air conditioning system as described above, the data communication between the outdoor unit and the indoor unit of each air conditioner is performed at a predetermined time interval on the basis of a polling signal output from the outdoor unit. In this case, in order to prevent interference (collision) between polling signals output from the respective air conditioners on the bus line, a time lag (phase shift) is applied between the output timings of the polling signals output from the respective outdoor units.

In the above-described air conditioning system, the controller of each outdoor unit contains a clock, and the output timing of the polling signal is managed on the basis of this clock. However, when a long time elapses from the mounting of the air conditioning system, the phase shift between the polling signals is gradually reduced due to the difference of precision between the clocks of the respective outdoor units, and finally the signals of the respective air conditioners may be output substantially at the same timing.

In this case, priority is generally given to the signal of an air conditioner which is output most (more) early in order to avoid interference between the signals, so that the communication of the other air conditioners cannot be performed.

That is, since the difference in precision between the clocks is generally very small (for example, about 10 microseconds for 10 seconds), a long time is needed for recovery until a sufficient phase shift is established again (for example, when the output interval of the polling signal is set to 10 seconds and a time for one communication is equal to 1 millisecond, 1000 seconds (about 17 minutes) is needed). For this recovery time, the signal of an air conditioner which is output most early is preferentially used at all times, and the data communication of the other air conditioners which output the polling signals later is intercepted.

Furthermore, in such an air conditioning system as described above, each outdoor unit is provided with a recording device such as a non-volatile memory for recording operation data. A maintenance operator can obtain past operating conditions from the data taken at periodic maintenance times and stored in the recording device. In the maintenance work, the operator detaches an outer panel, etc. from each outdoor unit and then connects a maintenance device to a connector of the outdoor unit to check the operation data of each air conditioner on the basis of a display content of a display unit or a print output. However, if large number of outdoor units are mounted on a big office building or a factory, then the outer panels of all the outdoor units must be detached from all the air conditioners to perform the maintenance work, so that the number of steps for the maintenance work and the maintenance time are increased.

SUMMARY OF THE INVENTION

The present invention has been implemented in view of the foregoing problems of the related art, and has a first object to provide an air conditioning system having plural air conditioners which are connected to one another through the same bus line and which can efficiently avoid the interference between signals on bus line.

Further, the present invention has a second object to provide an air conditioning system in which operation data of each outdoor unit can be checked by another outdoor unit through the bus line.

In order to attain the above objects, according to a first aspect of the present invention, an air conditioning system having plural air conditioners each comprising an outdoor unit and at least one indoor unit, the outdoor units and the indoor units of the plural air conditioners being connected to one another through a single bus line, is characterized by including timing changing means for changing the signal output timing of at least one air conditioner such that when signals of at least two air conditioners are output onto the bus line substantially at the same signal output timing, the signal output timings of the air conditioners are made different from one another.

According to the above-described air conditioning system, for example, when the signals of at least two air conditioners are output with a phase shift which is equal to or smaller than a predetermined value, the signal output timing of at least one of the air conditioners is changed by the timing changing means to increase or recover the phase shift and keep the phase shift between the signal outputs of the at least two air conditioners for a long term, whereby the communication between the indoor unit and the outdoor unit of each of the at least two air conditioners can be performed with no interception.

In the above-described air conditioning system, the signal output timings of the air conditioners which are output onto the bus line substantially at the same timing may be randomly changed by the timing changing means.

When the signals of two air conditioners are output onto the bus line substantially at the same signal output timing in the air conditioning system, the signal output timing of at least one air conditioner may be changed by the timing changing means.

According to the above-described air conditioning system, for example, when the signals of the two air conditioners are output with a phase shift which is equal to or smaller than a predetermined value, the signal output timing of one of the air conditioners or the signal output timings of the two air conditioners are changed by the timing changing means to increase or recovery the phase shift and keep the phase shift between the signal outputs of the two air conditioners for a long term, whereby the communication between the indoor unit and the outdoor unit of each of the two air conditioners can be performed with no interception.

In the above-described air conditioning system, the signal output timings of the two air conditioners may be randomly changed by the timing changing means.

According to the above air conditioning system, when the signals of the two air conditioners are output onto the bus line with a phase shift, which is below a predetermined value, the signal output timings of the air conditioners are randomly changed by the timing changing means, whereby the phase shift can be increased even when the outdoor units of the air conditioners have the same controller.

According to a second aspect of the present invention, an air conditioning system including plural outdoor units which are connected to one another through a single bus line, is characterized by including operation data recording means which is provided to each of the plural outdoor units and serves to record the operation data of the corresponding outdoor unit, operation data output means which is provided to at least one of the plural outdoor units and serves to output the operation data of a desired outdoor unit, and operation data transmitting means which is provided to each of outdoor units having no driving data output means and serves to transmit the operation data in the operation data recording means through the bus line to the at least one outdoor unit having the operation data output means.

Further, according to the present invention, an air conditioning system including plural outdoor units which are connected to one another through a single bus line, is characterized by including operation data recording means which is provided to each of the plural outdoor units and serves to record the operation data of the corresponding outdoor unit, operation data output means which is provided to each of the plural outdoor units and serves to output the operation data of a desired output unit, and operation data transmitting means which is provided to each of the plural outdoor units and serves to transmit the operation data in the operation data recording means through the bus line to the other outdoor units.

According to the above-described air conditioning system, a maintenance operator connects a maintenance device to a predetermined outdoor unit to input a predetermined command through a keyboard or the like, whereby the operation data of all the outdoor units can be displayed on a display device or the like of the maintenance device. Accordingly, the operator can know the operation data of any desired outdoor unit without checking each of the outdoor unit one by one.

DETAILED DESCRIPTION OF THE PREFERRED EMBODIMENTS

Preferred embodiments according to the present invention will be described in detail with reference to the accompanying drawings.

Figure 1:
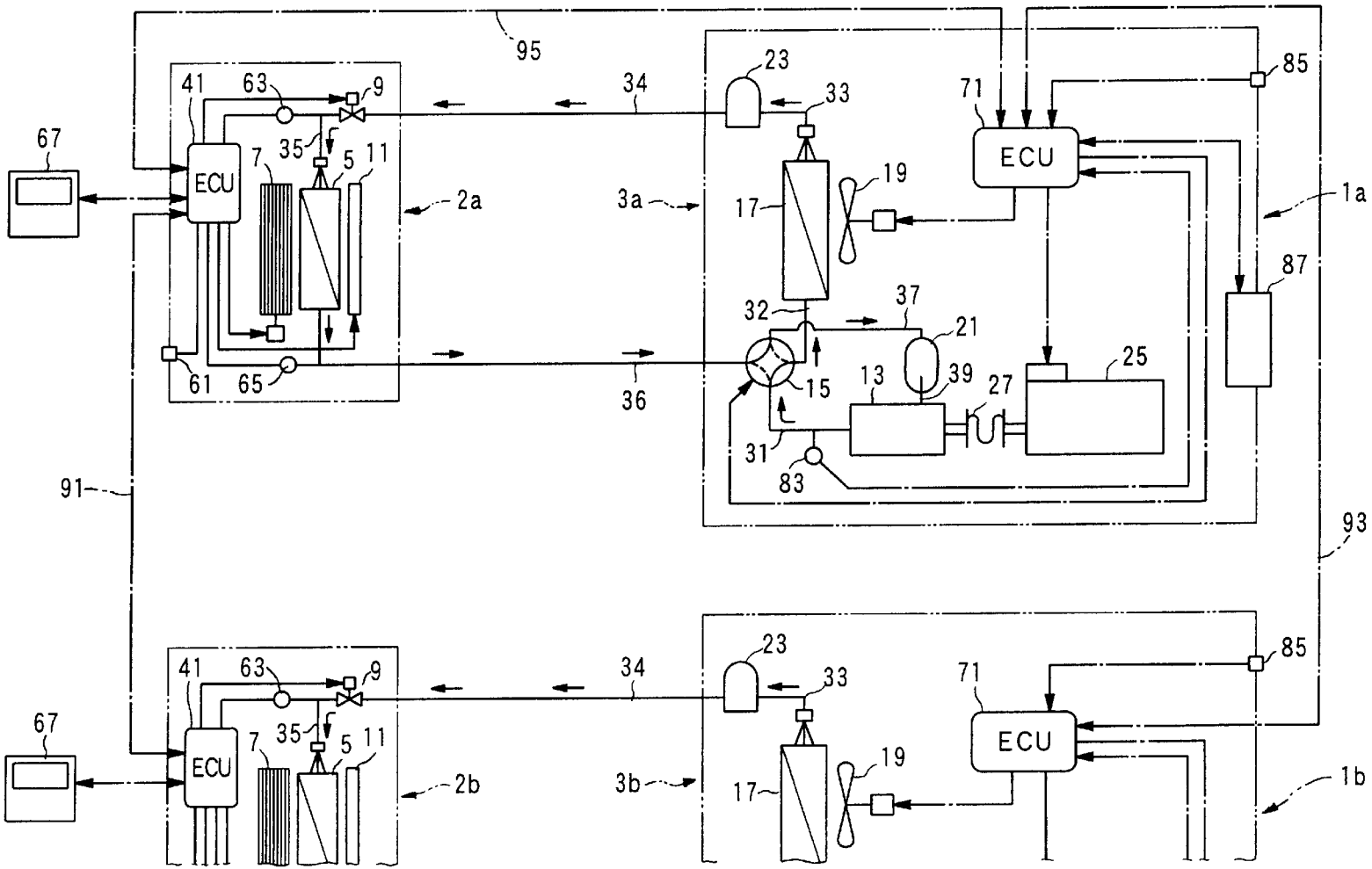
FIG. 1 is a schematic diagram showing an air conditioning system according to a first embodiment of the present invention.

FIG. 1 is a schematic diagram showing an air conditioning system comprising two air conditioners (a first air conditioner 1*a* and a second air conditioner 1*b*). In FIG. 1, a solid line represents a refrigerant circuit, a one-dotted chain line represents an electric circuit. The following first embodiment will be described in a case where the presents invention is applied to the air conditioning system having two air conditioners each of which is designed to have an outdoor unit and an indoor unit (i.e., one outdoor unit is connected to one indoor unit).

In FIG. 1, each of air conditioners 1*a* and 1*b* is of a gas heat pump type. The first air conditioner 1*a* comprises an indoor unit 2*a* and an outdoor unit 3*a*, and the second air conditioner 1*b* comprises an indoor unit 2*b* and an outdoor unit 3*b*. In each indoor unit 2*a*, 2*b* are disposed an indoor heat exchanger 5, an electric fan 6, a motor-operated fan 7, a motor-operated expansion valve 9, and an electric heater 11. Further, in each outdoor unit 3*a*, 3*b* are disposed a compressor 13, an electromagnetic four-way change-over valve 15, an outdoor heat exchanger 17, a motor-operated fan 19, an accumulator 21, and a receiver tank 23. These units constituting the refrigerant circuit are connected to one another by refrigerant pipes 31 to 39 which are used for flow of gas refrigerant or liquid refrigerant. In FIG. 1, reference numeral 25 represents a gas engine, and drives the compressor 13 through a flexible coupling 27.

In the indoor unit 2*a*, 2*b* is disposed an indoor controller unit (hereinafter referred to as "indoor ECU") 41 which comprises a CPU, an input/output interface, a ROM, and a RAM. The indoor ECU 41 is connected to the motor-operated fan 7, the motor-operated expansion valve 9, the electric heater 11, a room temperature sensor 61 for detecting room temperature Tr, first and second refrigerant temperature sensors 63 and 65 for detecting refrigerant temperature Tfi, Tfo at the inlet and outlet sides of the indoor heat exchanger 5 in cooling operation, a remote control unit 67, etc.

In the outdoor unit 3*a*, 3*b* is disposed an outdoor control unit (hereinafter referred to as "outdoor ECU") 71 which comprises a CPU, an input/output interface, a ROM, a RAM, a clock, and a non-volatile memory, etc. The outdoor ECU 71 is connected to a four-way change-over valve 15, a motor-operated fan 19, a gas engine 25, a pressure sensor 83 for detecting the refrigerant pressure Pd at the discharge side of the compressor 13, an outside temperature sensor 85 for detecting outside temperature Ta, a control panel 87, etc.

Both the indoor ECUs 41 are connected to each other through a first bus line 91, both the outdoor ECUs 71 are connected to each other through a second bus line 93, and the indoor ECU 41 and the outside ECU 71 of the first air conditioner 1*a* are connected to each other through a third bus line 95. In the first air conditioner 1*a*, signals are transmitted between the indoor ECU 41 and the outdoor ECU 71 by serial communication through the third bus line 95. Further, in the second air conditioner 1*b*, signals are transmitted between the indoor ECU 41 and the outdoor ECU 71 by serial communication through the first bus line 91, the third bus line 95 and the second bus line 93.

Next, the flow of refrigerant in cooling operation will be described.

Gas refrigerant which is sucked from the refrigerant pipe 39 into the compressor 13 is subjected to adiabatic compression to be discharged as high-temperature and high-pressure gas refrigerant from the compressor 13, and then flows through the refrigerant pipe 31, the four-way change-over valve 15 and the refrigerant pipe 32 into the outdoor heat exchanger 17. The high-temperature and high-pressure gas refrigerant is cooled by the outside air to be condensed into liquid refrigerant while passing through the outdoor heat exchanger 17, and then flows through the refrigerant pipe 33, the receiver tank 23 and the refrigerant pipe 34 into the motor-operated expansion valve 9.

The flow amount of the liquid refrigerant is adjusted by the motor operated expansion valve 9, and then flows through the refrigerant pipe 35 into the indoor heat exchanger 5. The liquid refrigerant is vaporized into gas refrigerant while passing through the indoor heat exchanger 5, whereby the indoor air blown by the motor-operated fan 7 is cooled by vaporization latent heat of the refrigerant. At this time, the indoor ECU 41 controls the rotational number (rpm) of the motor-operated fan 7 on the basis of the deviation between the set temperature Ts and the room temperature Tr, and also controls the valve opening degree of the motor-operated expansion valve 9 (the step number of a step motor for driving a valve disc) so that the deviation between the refrigerant temperature Tfi at the inlet side of the indoor heat exchanger 7 and the refrigerant temperature Tfo at the outlet side of the indoor heat exchanger 7 is equal to a predetermined value (for example, 0 to 1° C.).

The gas refrigerant which is vaporized in the indoor heat exchanger 5 flows through the refrigerant pipe 36, the four-way change-over valve 15 and the refrigerant pipe 37 into the accumulator 21, and then sucked from the refrigerant pipe 39 into the compressor 13 again.

Next, the operation of the air conditioning system according to this embodiment will described.

In this embodiment, a user operates the remote control units 67 for the first air conditioner 1*a* and the second air conditioners 1*b* to input to the indoor ECU 41 operational instructions such as an operation/stop instruction, a temperature adjusting instruction, a operational mode switching instruction, etc. The indoor ECU 41 transmits a current operation status to the outdoor ECU 71 by the serial communication through the third bus line 95 or the first, second and third bus lines 91, 93 and 95 at the time when a polling signal is input from the outdoor ECU 71 to the indoor ECU 41.

Figure 2:
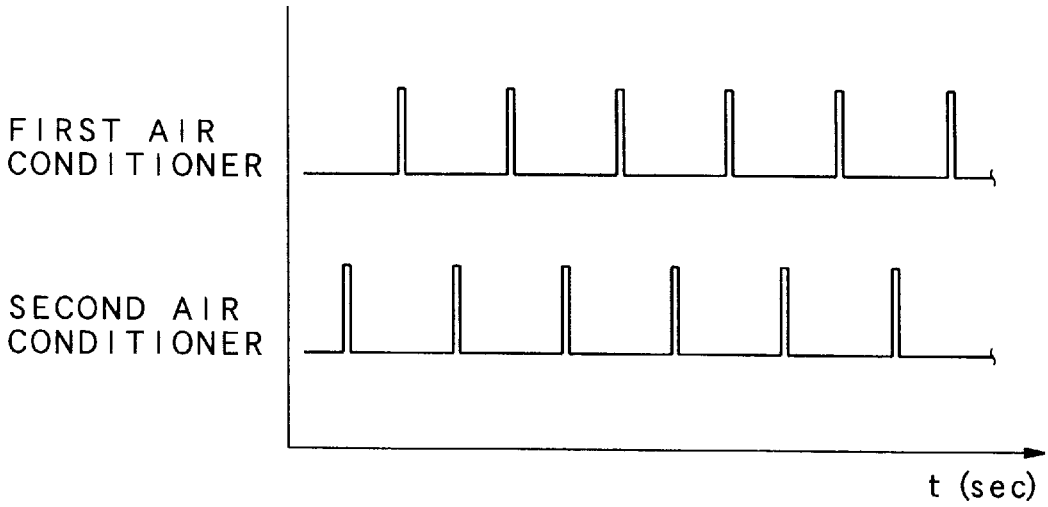
FIG. 2 is a time chart showing the output timing of a polling signal at a normal time.

Both of the air conditioners 1*a* and 1*b* are designed in the same construction, and each outdoor ECU 71 outputs the polling signal to the indoor ECU 41 at the same time interval (10 seconds in this embodiment). However, a predetermined phase shift (5 seconds in this embodiment) is applied between the output timings of the first air conditioner 1*a* and the second air conditioner 1*b* at the setup time of these air conditioners. Accordingly, at the setup time of the air conditioning system, the communication of the first air conditioner 1*a* (i.e., the data communication between the outdoor and indoor units of the first air conditioner 1*a*) and the communication of the second air conditioner 1*b* (i.e., the data communication between the outdoor and indoor units of the second air conditioner1*b*) can be performed at a sufficient time interval as shown in FIG. 2, so that there is no probability that the communications of these air conditioners 1*a* and 1*b* will interfere with each other on the bus line (in this case, the third bus line 95).

Figure 3:
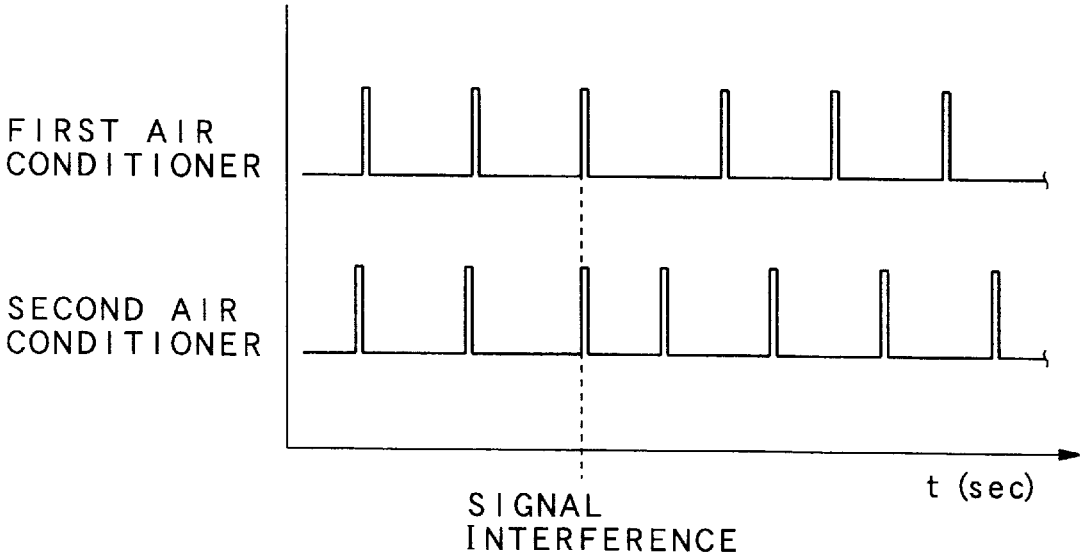
FIG. 3 is a time chart showing the operation of the first embodiment of the present invention.

However, when a long time elapses from the setup of the air conditioning system, the phase shift is gradually reduced due to a slight difference in precision between the clocks of the outdoor ECUs 71 of the air conditioners 1*a* and 1*b*, and finally there occurs a case where the communication timing of one air conditioner has come during the progress of the communication of the other air conditioner as shown in FIG. 3. According to this embodiment, at least one of the outdoor ECUs 71 of the air conditioners 1*a* and 1*b* changes the corresponding output timing of the polling signal at the time when the interference of the communication between the air conditioners is detected. In this embodiment, both the outdoor ECUs 71 are assumed to change the respective output timings of the polling signals.

In order to change the output timing, each of the outdoor ECUs 71 randomly select a change value (integer value second) in the range from 1 second to 9 seconds from a table in the ROM to shift the outputting timing of the polling signal to a plus side or a minus side by the selected change value. Accordingly, in many cases, a phase shift of several seconds occurs between the output timings of the polling signals from the outdoor ECUs 71 as shown in FIG. 3. Even when both the outdoor ECUs 71 select the same change value accidentally, the change of the output timing is performed again when the interference between the polling signals from both the outdoor ECUs 71 occurs next time, so that the interference of the communication can be avoided in a very short time.

As described above, according to the air conditioning system of this embodiment, the communication interference between the two air conditioners occurs little even when the two air conditioners use the single bus line commonly, and thus the operation of the air conditioning system can be stably controlled.

The present invention is not limited to the above-described embodiment. For example, the above-described embodiment is directed to an air conditioning system comprising gas heat pump type air conditioners, however, the air conditioning system may comprises air conditioners each having a motor-operated compressor. Further, the above-described embodiment is directed to an air conditioning system having two air conditioners each of which includes one outdoor unit and one indoor unit. However, the air conditioning system may comprise air conditioners each of which includes one outdoor unit and plural indoor units connected to the outdoor unit. Further, the number of the air conditioners constituting the air conditioning system is not limited to two, and it may be equal to three or more.

Further, in the above-described embodiment, each of the outdoor ECUs of both the air conditioners changes the output timing of the polling signal. However, only one of the outdoor ECUs may change the output timing by a predetermined change value (5 seconds, for example). Still further, the specific construction of the air conditioning system may be modified or altered without departing from the subject matter of the present invention.

Next, an air conditioning system according to a second embodiment of the present invention will be described.

The second embodiment will be described by representatively using an air conditioning system with plural air conditioners each having such a structure that plural indoor units are connected to one outdoor unit.

The air conditioner of this embodiment has substantially the same structure as that of the first embodiment except that one outdoor unit is connected to plural indoor units, and the flow of the refrigerant in the refrigerant circuit during cooling operation is the same as the first embodiment. The description on these overlap portions between the first and second embodiments is omitted from the following description in order to avoid the duplicative description, and the same portions are represented by the reference numerals.

Figure 4:
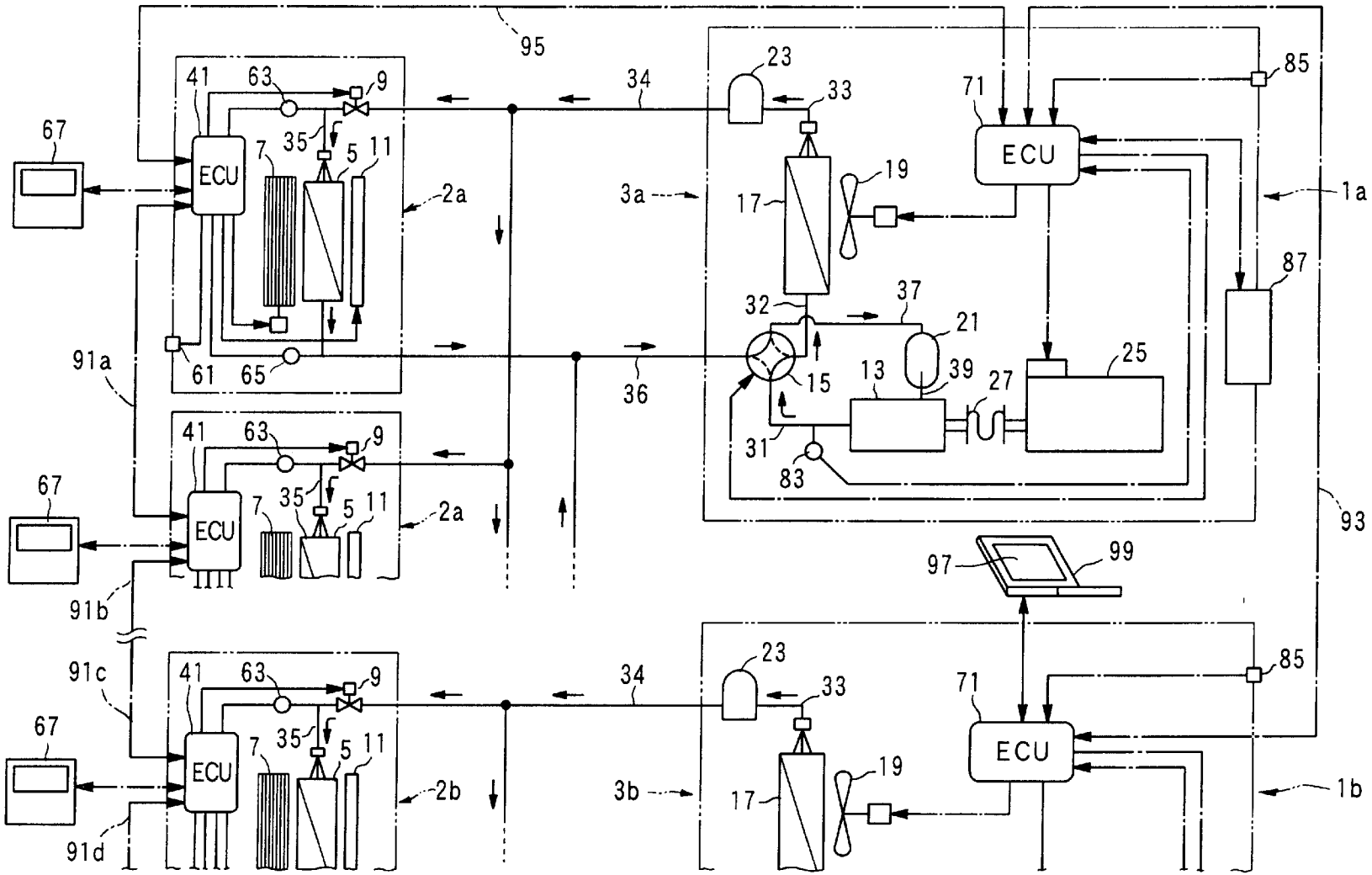
FIG. 4 is a schematic diagram showing an air conditioning system according to a second embodiment of the present invention.

FIG. 4 is a schematic diagram showing an air conditioning system comprising two air conditioners (first air conditioner 1*a'* and second conditioner 1*b'*) according to the second embodiment. In FIG. 4, a solid line represents a refrigerant circuit, and a one-dotted chain line represents an electrical circuit.

The difference of the air conditioning system of the second embodiment from the first embodiment resides in that the first air conditioner 1*a'* comprises plural indoor units 2*a* and one outdoor unit 3*a*, and the second air conditioner 1*b'* comprises indoor units 2*b* and one outdoor unit 3*b*, and also in the first air conditioner 1*a'*, signals are transmitted between each of the indoor ECU 41 and the outdoor ECU 71 by the serial communication through the first bus line 91 and the third bus line 95. Reference numeral 99 in FIG. 4 represents a maintenance device 99 having a display 97.

The operation of the air conditioning system of the second embodiment will be described hereunder.

In this embodiment, a user operates the remote control units 67 for the first air conditioner 1*a'* and the second air conditioners 1*b'* to input to the indoor ECU 41 of each indoor unit 2*a*, 2*b* operational instructions such as an operation/stop instruction, and a temperature adjusting instruction, a operational mode switching instruction. The indoor ECU 41 transmits a current operation status to the outdoor ECU 71 by the serial communication through the third bus line 95 or the first, second and third bus lines 91, 93 and 95 at the time when a polling signal is input from the outdoor ECU 71 to the indoor ECU 41. On the basis of the operation status of the indoor ECU 41, the outdoor ECU 71 controls the driving of the four-way change-over valve 15, the motor-operated fan 19, the gas engine 25, and also successively records the operation data thereof in a built-in non-volatile memory.

When the operation data of the outdoor units 3*a*, 3*b* are required to be checked in a periodic check work or due to occurrence of a trouble, a maintenance operator detaches the outer panel of any outdoor unit (for example, the outdoor unit 3*b*), and connects the maintenance device having the display 97 to the outdoor ECU 71 of the outdoor unit. When the maintenance operator inputs through a keyboard a command for displaying the operation data of the outdoor unit 1*b'*, the operation data of the outdoor unit 3*b* recorded in the non-volatile memory are displayed on the display 97. On the basis of the display, the maintenance operator checks the latest operation data of the outdoor unit 3*b* and makes any necessary countermeasure, such as supplement of refrigerant, adjustment of the engine or the like.

Further, when no abnormality occurs in the outdoor unit 3*b*, the operator operates the keyboard of the maintenance device 99 again to input a command for displaying the operation data of the outdoor unit 1*a'*. At this time, the command is transmitted through the second bus line 93 to the outdoor ECU 71 of the air conditioner 1*a'*, and the operation data of the outdoor unit 3*a* are output from the non-volatile memory. The operation data thus output are displayed on the display 97 of the maintenance device 99 through the second bus line 93 and the outdoor ECU 71 of the outdoor unit 3*b*, whereby the operator can check the operation data of the outdoor unit 1*a* without connecting the maintenance device 99 to the outdoor ECU 71 and finish the maintenance work if no abnormality is detected.

As described above, according to the air conditioning system of this embodiment, by connecting the maintenance device to one outdoor unit, the operation data of the other outdoor units can be checked through the common bus line, so that the maintenance work can be easily performed in a short time. Further, the maintenance device can be connected to any outdoor unit through the bus line, so that the access of the maintenance operator to any outdoor unit is facilitated.

The present invention is not limited to the above-described embodiment. For example, the above-described embodiment is directed to an air conditioning system comprising gas heat pump type air conditioners, however, the air conditioning system may comprises air conditioners each having a motor-operated compressor. Further, the above-described embodiment is directed to an air conditioning system having two air conditioners each of which includes one outdoor unit and one indoor unit. However, the air conditioning system may comprise air conditioners each of which includes one outdoor unit and plural indoor units connected to the outdoor unit. Further, the number of the air conditioners constituting the air conditioning system is not limited to two, and it may be equal to three or more.

Further, in the above-described embodiment, the operation data is displayed on the display of the maintenance device, however, the data may be displayed on a control panel of the outdoor unit, or printed. Further, the specific construction of the air conditioners may be suitably modified and altered without departing from the subject matter of the present invention.

As described above, according to the air conditioning system of the present invention, in the air conditioning system which includes plural air conditioners each comprising an outdoor unit and an indoor unit, the outdoor units and the indoor units of the air conditioners are connected to one another through the single bus line, when the signals of the two air conditioners are output onto the bus line substantially at the same timing, the signal output timing of at least one air conditioner is changed by the timing changing means. Therefore, even when the signals of the two air conditioners are output with a phase shift which is below a predetermined value, the phase shift is increased or recovered in a short time and thus the communication between the outdoor unit and the indoor unit of each air conditioner can be prevented from being disturbed.

Further, according to the air conditioning system of the present invention, the air conditioning system having plural outdoor units which are connected to one another through the same bus line, is further provided with the operation data recording means which is provided to each of the plural outdoor units and serves to record the operation data of the corresponding outdoor unit, operation data output means which is provided to at least one of the plural outdoor units and serves to output the operation data of a desired outdoor unit, and operation data transmitting means which is provided to each of outdoor units having no driving data output means and serves to transmit the operation data in the operation data recording means through the bus line to the at least one outdoor unit having the operation data output means. Therefore, when the maintenance operator inputs a predetermined command through a keyboard or the like, the operation data of al the outdoor units can be displayed on the display or the like of the maintenance device, and the maintenance work can be easily performed in a short time.

What is claimed is:

1. An air conditioning system comprising:

plural air conditioners each comprising an outdoor unit and at least one indoor unit, said outdoor units and said indoor units of said plural air conditioners being connected to one another through a single bus line; and timing changing means for changing a signal output timing of at least one air conditioner when signals of at least two of said air conditioners are output onto said bus line substantially at the same signal output timing, so that the signal output timings of said air conditioners differ from one another.

2. The air conditioning system according to claim 1, wherein the signal output timing of each of said air conditioners is randomly changed by said timing means.

3. The air conditioning system according to claim 2, wherein said timing changing means comprises: means for randomly selecting a change value for each of said air conditioners; and means for shifting the signal output timing of each of said air conditioners by the associated selected change values.

4. The air conditioning system according to claim 1, wherein each of said air conditioners comprises an outdoor unit and an indoor unit, and when signals of any two air conditioners are output onto said bus line substantially at the same signal output timing, said timing changing means changes the signal output timing of at least one of said two air conditioners.

5. The air conditioning system according to claim 4, wherein said timing changing means randomly changes the signal output timing of at least one of said two air conditioners.

6. The air conditioning system according to claim 5, wherein said timing changing means comprises:

means for randomly selecting a change value for at least one of said air conditioners; and means for shifting the signal output timing of at least one of said two air conditioners by the associated selected change value.

7. An air conditioning system comprising:

plural air conditioners each comprising an outdoor unit and at least one indoor unit, said outdoor units and said indoor units of said plural air conditioners being connected to one another through a single bus line; and timing changing means for changing the signal output timing of at least one air conditioner, when interference of communication between at least two of said air conditioners is detected, so that the signal output timings of said air conditioners differ from one another.

* * * * *